US005914304A

United States Patent [19]

Croud et al.

[11] Patent Number: 5,914,304

[45] Date of Patent: Jun. 22, 1999

[54] BLEACHING COMPOSITIONS

[75] Inventors: Vincent Brian Croud, Holywell; Stephen James Tompsett, West Yorkshire; Susan Jane Scarborough, Rhuddlan, all of United Kingdom

[73] Assignee: Warwick International Group, Ltd., United Kingdom

[21] Appl. No.: 08/765,430

[22] PCT Filed: Jun. 30, 1995

[86] PCT No.: PCT/GB95/01536

§ 371 Date: Apr. 25, 1997

§ 102(e) Date: Apr. 25, 1997

[87] PCT Pub. No.: WO96/01310

PCT Pub. Date: Jan. 18, 1996

[30] Foreign Application Priority Data

Jul. 1, 1994 [GB] United Kingdom ..... 9413307
Mar. 24, 1995 [GB] United Kingdom ..... 9506046

[51] Int. Cl.[6] ..... C11D 7/18; C11D 7/54; C11D 9/42; C11D 3/00

[52] U.S. Cl. ..... 510/367; 510/375; 510/376; 252/186.1

[58] Field of Search ..... 510/303, 304, 510/309, 339, 367, 372, 375, 376, 467, 469

[56] References Cited

U.S. PATENT DOCUMENTS

| | | | |
|---|---|---|---|
| 3,860,391 | 1/1975 | Kling et al. | 8/111 |
| 3,951,594 | 4/1976 | Smolens | 8/111 |
| 3,951,840 | 4/1976 | Fujino et al. | 252/102 |
| 4,294,575 | 10/1981 | Kowalski | 8/111 |
| 4,347,149 | 8/1982 | Smith et al. | 252/102 |
| 4,497,725 | 2/1985 | Smith et al. | 252/102 |
| 4,525,291 | 6/1985 | Smith et al. | 252/95 |
| 5,130,053 | 7/1992 | Feasey et al. | 252/400 |
| 5,180,514 | 1/1993 | Farr et al. | 252/99 |
| 5,349,083 | 9/1994 | Brougham et al. | 562/6 |
| 5,478,356 | 12/1995 | Kaaret | 8/111 |
| 5,545,343 | 8/1996 | Brougham et al. | 514/557 |
| 5,707,542 | 1/1998 | Deline et al. | 252/186.38 |

FOREIGN PATENT DOCUMENTS

| | | |
|---|---|---|
| 0037184 | 10/1981 | European Pat. Off. . |
| 0076166 | 4/1983 | European Pat. Off. . |
| 0449797 | 10/1991 | European Pat. Off. . |
| 2030609 | 4/1980 | United Kingdom . |
| 2072643 | 10/1981 | United Kingdom . |
| 91/09807 | 7/1991 | WIPO . |
| 9109807 | 7/1991 | WIPO . |
| 93/13012 | 7/1993 | WIPO . |
| 9313012 | 7/1993 | WIPO . |

*Primary Examiner*—Paul Lieberman
*Assistant Examiner*—John M. Petruncio
*Attorney, Agent, or Firm*—Ostrolenk, Faber, Gerb & Soffen, LLP

[57] ABSTRACT

Concentrate liquid peroxide compositions, especially bleaching and washing compositions of improved stability are produced in a process in which components incorporated into the liquid composition after blending of peroxide with components including a sequestering agent, are subjected to a presequestration stage. In the presequestration stage the further component is contacted with one or more sequestering agents, especially sequestrants which are capable of sequestering transition metal ions, especially a mixture in which one component is capable of sequestering cobalt and other components are not effective in sequestering cobalt. The invention is of particular value where the further component is a pH modifying solution, especially an alkali.

21 Claims, No Drawings

BLEACHING COMPOSITIONS

This invention relates to liquid oxidising compositions which contain peroxide. The invention particularly relates to concentrates of bleaching compositions which contain peroxide and which can be diluted by the user to obtain a washing composition.

Aqueous peroxide-containing compositions are known, but may lack stability. It is desirable to produce alkaline peroxide-containing aqueous liquids because the activity of the peroxide is enhanced as compared to acidic liquors and alkaline solutions are preferred for some applications.

However, it is well known that aqueous alkaline conditions present particular difficulties for liquid compositions containing peroxide because the peroxide tends to decompose rapidly under such conditions. Therefore, there are considerable difficulties in trying to produce an alkaline peroxide-containing composition which is sufficiently storage stable. One way of overcoming this problem is to prepare an alkaline peroxide-containing composition and use it immediately, for example as described in GB-A-2030609, so that storage stability is not required. This reference relates to protection of metal complex-based dyes or pigments when fibrous articles are bleached. The bleaching compositions therefore include chelating agents: dimethyl glyoxime and an amino carboxylic acid. The present inventors have found that aminocarboxylic acids such as EDTA are not effective in stabilising liquid peroxide compositions.

There have however been several attempts to prepare stabilised liquid compositions which are alkaline and which contain peroxide. For example in U.S. Pat. No. 3,951,840, U.S. Pat. No. 5,180,514, GB-A-2,072,643, EP-A-0,076,166 and EP-A-0,037,184 several different methods are disclosed, all of which require the use of an alcohol as a stabilising agent.

In U.S. Pat. No. 3,951,840, a solid peroxide bleaching composition is prepared incorporating, for stability, a chelating agent capable of forming a water-soluble or poorly water-soluble compound. The chelating agent is either added to the final composition or it is present during the reaction of sodium carbonate, sodium pyrophosphate or sodium borate with hydrogen peroxide to form the inorganic bleaching agent. It is reported that the presence of the sequestering agent during that reaction produced more stable peroxide adduct components.

In U.S. Pat. No. 5,180,514, aqueous peroxide bleaching compositions are described. It is described that trace metal cations in amounts of 0.5 ppm or greater result in deterioration of peroxide compositions. Stabilisation is achieved in this reference by incorporating a heavy metal sequestering agent or chelating agent and an aromatic amine free radical scavenging agent. The pH of the bleach compositions is said to be in the range 1 to 8, more preferably 1 to 6 and most preferably 2 to 4. In the examples, the stabilised bleach formulations prepared are all acidic.

In GB-A-2,072,643, stability is obtained using a combination of non-aqueous solvent (ethanol), amino compounds substituted by acetate or methylene phosphonates and hydroxy alkyl diphosphonates, particularly with a polyhydroxy carboxylate, preferably gluconate or an amino acetate. The particular difficulty of preventing the hydrogen peroxide from decomposing on storage in an alkaline composition is discussed. It is specifically stated that deionised water is used to minimise peroxide decomposition.

In EP-A-0,076,166, stabilisation is achieved using a combination of isopropanol and an aminomethylene phosphonate or hydroxyalkyl diphosphonate, optionally with a polyhydroxy aliphatic carboxylate.

In WO91/09807, stabilisation is achieved by introducing amino poly(alkylene phosphonic acid) or a salt thereof, into a concentrated aqueous acidic solution of hydrogen peroxide, storing the mixture until the aminopoly(alkylene phosphonic acid) or salt has been converted to a derivative in the acidic solution and then diluting the concentrate with alkali to form a mildly alkaline solution.

In WO93/13012, an aqueous alkaline hydrogen peroxide composition is buffered and stabilised using disodium tetra borate decahydrate and cyclohexane-1,2-diaminotetramethylenephosphonic acid. In the preparation of the composition exemplified, the phosphonic acid stabiliser was introduced into a buffered solution and shortly after an aqueous solution containing tetradecyldimethylamine oxide, a perfume and water and then aqueous hydrogen peroxide solution were added to the stabiliser-containing mixture and finally, sodium hydroxide was added until the composition reached a pH of 8.5.

In EP-A-0,037,184, stabilisation is achieved using a combination of an alcohol and/or a polyhydroxy carboxylate, preferably gluconate in conjunction with a phosphonate, especially ethylene diamine tetra (methylene phosphonic acid). The compositions are prepared by forming a mixture of surfactant, then adding all of the other ingredients, with the hydrogen peroxide being added last.

In the known peroxide compositions, the peroxide may be added to a composition while the composition is acidic, to try to prevent decomposition and loss of peroxide. In order to produce alkaline compositions, alkali is then required to be added. Alternatively, the peroxide is added as the last component, after alkali. However, it has been found that alkaline peroxide compositions prepared in this way have poor stability and do not provide adequate shelf-life for a useful commercial product.

Thus, the problem of lack of stability of peroxide in aqueous alkaline compositions is well recognised and many methods have been described for trying to stabilise such compositions. As will be seen from above, these include the incorporation of non-aqueous solvents, sequestering agents, free-radical scavengers and use of deionised water.

Whilst it is recognised that the prior art may improve the stability of hydrogen peroxide-containing compositions under alkaline conditions, the gain in stability resulting from the prior art disclosures is short term only. There is therefore, still a need for an improved one-pack peroxide-containing aqueous alkaline oxidising composition which will maintain sufficient stability to have a useful shelf-life.

Having studied the decomposition of peroxide in aqueous solution under alkaline conditions in detail, the present inventors have found that aqueous alkaline peroxide-containing compositions can be prepared having sufficient long term stability that they can provide a commercial product, even when additional materials are added after the peroxide to a liquid composition.

Therefore, in accordance with the present invention there is provided a process for preparing a liquid oxidising concentrate composition comprising peroxide and a sequestering agent, the process comprising providing a solution of sequestering agent in a liquid, adding peroxide to the liquid to form a peroxide solution and subsequently, adding to the peroxide solution a pre-sequestered further component.

The liquid which comprises sequestering agent in solution is generally aqueous. It may be acidic or alkaline but is preferably alkaline, generally having a pH no less than 7.5, preferably the pH being at least 7.8, or even at least 8.0, or 8.5.

The aqueous liquid is preferably alkaline because generally the product solution will be alkaline, generally having a pH no less than 7, preferably no less than 7.5 or even at least 7.8 or 8.0. The performance of sequestering agents is often pH dependent and therefore preferably the aqueous liquid comprising the sequestering agent has a pH which is lower than about the pH of the oxidising concentrate composition being produced, more preferably the pH of the aqueous liquid comprising the sequestering agent has a pH between 2 pH units, and most preferably 1 pH unit, below and about the pH of the product oxidising concentrate composition.

A pH-modifying component will generally be incorporated into the product solution and this will generally be the further component. Generally, the pH-modifying component will be an alkali since the oxidising composition is generally alkaline.

The aqueous liquid and pH-modifying component for preparing an aqueous composition may be provided in the form of an aqueous solution of pH-modifying component or may be introduced separately as water and pH-modifying components.

There may be one, or a combination of more than one sequestering agents in the solution of sequestering agent in liquid. Most preferably, there is at least one Group A sequestering agent and at least one Group B sequestering agent.

The Group A sequestering agent is one which is capable of sequestering cobalt so that a peroxide solution is stabilised against decomposition by cobalt catalysis. It may be capable of sequestering other transition metal ions which cause peroxide decomposition as well. The Group B sequestering agents are capable of sequestering transition metal ions which cause peroxide decomposition but not effective in sequestering cobalt at least at alkaline pH's. The combination of sequestering agents is thus able to sequester a combination of transition metal ions and thereby minimise peroxide decomposition. This aspect is described in more detail in co-pending application Ser. No. 08/765,648.

The Group A sequestering agent is preferably selected from compounds having nitrogen donors as ligands, such as triazacycloalkane compounds especially 1,4,7-triazacyclononanes (TACNs), or dipyridylamine (DPA), as well as some phosphonate compounds wherein the molecule has limited flexibility and appropriate spacing of the ligands such as 1,2-diaminocyclohexyl tetra(methylene phosphonic acid) and salts thereof (DACH). DACH and/or DPA are particularly preferred. The Group B sequestering agent is preferably selected from non-cyclic (alkylene) amino poly (methylene phosphonic acids), and their salts, as well as other phosphonic acid derivatives such as 1-hydroxyethane-1,1-diphosphonic acid and higher alkylidene analogues thereof. Particularly preferred Group B sequestering agents include diethylene triamine penta(methylene phosphonic acid) and salts thereof, ethylene diamine tetra(methylene phosphonic acid) and salts thereof and amino tri(methylene phosphonic acid) and its salts.

Particularly preferred classes of phosphonate sequestering agents are supplied by Monsanto under the Dequest trade mark and by Albright & Wilson under the Briquest trade mark.

In a particularly preferred embodiment of the invention, the aqueous liquid will comprise a mixture of sequestering agents as disclosed in said co-pending application Ser. No. 08/765,648.

The Group A sequestering agent is generally present in the aqueous liquid in amounts of at least 0.005% by weight, preferably at least 0.01% by weight, preferably no greater than 2% by weight or no greater than 1% by weight or, more particularly from 0.02 to 0.6% by weight, during the pre-sequestration step.

The amount of the Group B sequestering agent in the aqueous alkaline liquid is generally at least 0.005% by weight, preferably at least 0.01% by weight. Generally, it will be no greater than 2% by weight, preferably no greater than 1% by weight and most preferably no greater than 0.5% by weight of the total composition.

Preferably, prior to addition of the peroxide to the aqueous liquid, the aqueous liquid (and preferably in addition any optional components included in the aqueous liquid) has undergone pre-sequestration in a pre-treatment step by contact with one or more sequestering agents for a period of time to enable transition metal ion complexes to form. For example contact of the aqueous alkaline liquid in an aqueous liquid with one or more sequestering agents for at least 45 minutes.

The peroxide which is added to the aqueous liquid will be at least partially soluble in the aqueous liquid and may be one or mixtures of more than one of hydrogen peroxide, organic peroxides and inorganic persalts which liberate hydrogen peroxide in water. Suitable examples of inorganic persalts include alkali metal salts of perforate, persulfate, perphosphate or percarbonate. This invention has been found to be particularly advantageous because it enables the use of hydrogen peroxide which, being a liquid under normal conditions of use is a particularly easily decomposed form of peroxide and is therefore particularly problematic. Hydrogen peroxide is particularly preferred as it has a higher rate of reaction in use, because it does not require dissolution time. Pre-formed peracids may also be used as the peroxide component. Examples are perbenzoic or peracetic acid. A pre-formed peracid may be used in addition to a peroxide salt or hydrogen peroxide and if so, the peracid may be encapsulated.

The amount of peroxide in the final composition will generally be such as to provide a concentration in the product solution equivalent to hydrogen peroxide (100%) in an amount of at least 0.25% preferably at least 0.5, most preferably at least 1%, or even at least 3%. Generally it will be no greater than 15%, preferably below 10% and most preferably below 7% by weight of the oxidizing composition.

The addition of the peroxide to the aqueous liquid will generally be by pouring a liquid peroxide solution into the aqueous liquid. Alternatively, where the peroxide is provided in the form of a solid persalt, it may be added directly to the aqueous liquid, optionally followed by mixing to promote dissolution. Alternatively a solid persalt may be suspended in the product concentrate, whilst at least a portion of such solid persalt will become dissolved in the aqueous liquid phase.

The addition of the peroxide generally alters the pH of the aqueous liquid. Where the resulting pH is either too low or too high, the further presequested component may comprise pre-sequestered pH-modifier. Where the peroxide source is commercially available hydrogen peroxide, the pH will decrease and where the peroxide source is a persalt, it is likely to increase. The pH-modifier will be selected accordingly from acids or alkalis.

The pH modifier may be any conventional acid or alkali. For the acid mineral acids are suitable. For the alkali, generally hydroxides, especially alkali metal hydroxides may be added. The amount of alkali used is such that the pH of the product concentrate composition will be at least 7, generally at least 7.5, and generally no greater than 13.5. Preferably, the pH of the product concentrate composition is at least 8 and up to around 11, most preferably in the range of from 9 to 10.5.

The pH-modifier is generally added in aqueous solution, but may be added as a solid, for example as a water soluble salt oxide or hydroxide. In a particular, alkalis may be added as a salt. The pre-sequestration of solids is discussed in more detail below.

Other further presequestered components which may be added to the peroxide solution to produce the product solution include optional components which may be any of the additives used in oxidising concentrates, especially detergent compositions, for example surfactants, builders, bleach activators, electrolytes, hydrotropes, decoupling polymers, optical brighteners, dyes, colours, fragrances, anti-redeposition agents, dye-transfer inhibitors, enzymes and/or free radical scavengers, additional peroxide stabilisers, buffers and perfumes and physical property (rheology) altering components such as thickeners and structuring agents.

Thickeners and structuring agents increase the viscosity of the liquid and it is often therefore advantageous to add these components after the peroxide has been added to ensure that peroxide dispersal throughout the aqueous liquid is as effective as possible. The aqueous liquid may already be relatively viscous and additional thickening or structuring agents may reduce the rate of dispersal of peroxide throughout the composition.

Suitable thickening agents include for example gelatin.

Suitable structuring agents include for example sodium citrate, sodium tripolyphosphate and sodium sulphate.

In order to pre-sequester a further component for addition to the peroxide solution, the or each further component must have been contacted with sequestering agent in a pre-sequestration step. For the addition of further components as solids, for example for a pH-modifier or any other further component which is crystalline and which can be provided in solid form either for dissolution or suspension in the peroxide solution, it has been found that it is particularly advantageous if, for the pre-treatment step, the solid is dissolved in a solution, preferably aqueous, containing the sequestering agent(s) or to which the sequestering agent(s) is added, and subsequently, the crystalline solid is recrystallised out of solution by any conventional means. The crystalline solid may then be redissolved or added directly to the peroxide solution.

The sequestering agent for use in the pre-sequestration step of any further component may be any known sequestering agent for transition metal ions. Any of the Group A or Group B sequestering agents may be used. There may be a plurality of sequestering agents for example combinations of sequestering agents may be as described in more detail in the aforementioned co-pending application.

Generally contact of the further component with sequestering agent will be in aqueous solution.

Preferably the pre-sequestration treatment of any further component(s) will ensure that there is contact with the sequestering agent or preferably, mixtures of sequestering agents for a time period to allow stable complexes to form, usually at least 45 minutes and preferably at least 2 hours. Since the pre-sequestration can be carried out on stock solutions, the time may be at least 1 day and often several days. The conditions of temperature are conveniently ambient.

Preferably, the further component is pre-sequestered using one of the sequestering agents used in the peroxide solution.

In the pre-sequestration step for the further component or components, the sequestering agent is generally present in amounts of at least 0.005% by weight, preferably at least 0.01% by weight, preferably no greater than 5% by weight or no greater than 2% by weight or, more particularly from 0.02 to 0.6% by weight, during the pre-sequestration step. The preferred sequestering agent is diethylene triamine pentamethylene phosphonic acid or one of its salts.

When a mixture of sequestering agents is used, preferably the mixture will comprise a Group A sequestering agent and a Group B sequestering agent.

Since the sequestering agents sequester any transition metal ions in the aqueous liquid so that they are no longer catalytic in peroxygen decomposition i.e. to form stable complexes with the transition metal ions which do not cause peroxide decomposition, the stability of the peroxide-containing compositions is significantly improved.

The method according to the present invention may be used to prepare an oxidising concentrate composition for any application.

The product solution of oxidising concentrate composition may include optional components which may be any of the additives used in oxidising concentrates, especially detergent compositions, for example surfactants, builders, bleach activators, electrolytes, hydrotropes, decoupling polymers, optical brighteners, dyes, colours, fragrances, anti-redeposition agents, dye-transfer inhibitors, enzymes and/or free radical scavengers, additional peroxide stabilisers, buffers, perfumes and/or pH modifiers. These optional components may be present either in the aqueous liquid comprising sequestering agent, prior to peroxide addition, or may be added as further presequestered components.

Preferably the optional components which are incorporated in the aqueous alkaline liquid comprising sequestering agent have been pre-sequestered so that they have been in contact with the sequestering agent or mixtures of sequestering agents for at least 45 minutes.

Oxidatively, perhydrolytically or hydrolytically unstable materials if incorporated into the oxidising composition are preferably suitably protected, for example by releasable encapsulation, prior to incorporation.

Generally the oxidising concentrate compositions of the present invention will be bleaching compositions, especially cleaning compositions, that is cleaning compositions which are diluted with water to produce bleaching liquor or detergent liquor, preferably they will contain at least one surfactant.

The surfactant may be anionic, nonionic or cationic or mixtures of such surfactants. The incorporation of anionic surfactants has been found to cause the most difficulties with respect to rate of decomposition of peroxide in an alkaline peroxide composition. In the present invention, one of the particular advantages which have been found is that anionic surfactants can be incorporated into the oxidising concentrate compositions while surprisingly, maintaining good stability of the peroxide composition.

Suitable anionic surfactants include any surfactant useful in a detergent for example salts of sulphonic or monoesterified sulphuric acids such as alkyl benzene sulphonate, alkyl sulphates, alkyl ether sulphates, olefin sulphonates, alkyl phenol sulphates, alkyl phenol ether sulphates, alkyl ethanolamine sulphate, alkyl ethanolamine ether sulphates, alpha sulpho fatty acids or esters, each having at least one alkyl or alkenyl group from 8 to 22, more usually 10 to 20 aliphatic carbon atom and the alkyl or alkenyl groups preferably being straight chain primary groups. Other suitable anionic surfactants include fatty alkyl sulphosuccinates, fatty alkyl ether sulphosuccinates, acyl sarcosinates, acyl taurides, and paraffin sulphonates. The preferred anionic surfactants are salts of alkali metals or alkaline earth metals, preferably sodium. Other salts include ammonium, monoethanolamine, diethanolamine, triethanolamine and alkyl amines having up to 7 aliphatic carbon atoms. Particularly preferred examples of anionic surfactants for use in the present invention include sodium dodecylbenzene sulphonate, potassium hexadecylbenzene sulphonate, lauryl ether sulphate, and paraffin sulphonates.

Suitable nonionic surfactants include for example alkanolamides (such as C10 to C20) and/or ethoxylated alcohols, carboxylic acids, amines, alcohol amides, alcohol phenol, glyceryl esters, sorbitan esters, phosphate esters etc.

Suitable cationic surfactants include for example quaternary amines, imidizolines and quaternised imidizolines. Amphoteric surfactants may also be used.

All of the percentages given below are by weight as a percentage of the total weight of the oxidising composition. Surfactants are generally incorporated into the composition of the present invention in amounts of at least 1%, or even at least 5%, preferably at least 10% by weight of the finished oxidising composition. Preferably the amount of surfactant in the composition will be up to 60% by weight and most preferably up to 50% by weight.

Typically the formulation will be a heavy-duty laundry detergent containing a high proportion of active components, including at least 10% by weight surfactant, preferably at least 15% or even at least 25%. The formulation may therefore be for example either isotropic or structured. Structured compositions may include decoupling polymers, optionally with electrolyte and isotropic compositions may include hydrotrope optionally with electrolyte. The optional other components of the composition are therefore selected according to the desired formulation.

Any builder which is conventional for use in detergent compositions may be used in the compositions of the present invention such as phosphates, carbonates, zeolites, acetates, citrates, metaphosphate, pyrophosphate, phosphonate, EDTA and/or polycarboxylates or silicates. The builder may also contribute to the electrolyte concentration in the composition. Builders such as silicates may also contribute to the alkalinity of the compositions of the present invention. A preferred builder is an alkali metal citrate salt.

Certain builders or complexing agents may interfere with the sequestration of transition metal ions by the sequestering agents in the invention thereby decreasing the stability of the formulations, for example zeolites, phosphates, EDTA, polycarboxylates and/or additional phosphonates which may compete with the concentrate stabilising sequestrant system. If, for performance reasons, these are preferred components they are preferably included in a form such as to prevent this interference but still in a form which can be released into the use liquor, eg wash bath upon dilution with water, preferably by encapsulation.

Builders may be incorporated in the composition in amounts of from 0 to 40% by weight of the total composition, preferably at least 2%, most preferably at least 5%, generally no greater than 30% and preferably no greater than 25% by weight of the final composition.

Bleach activators may be used in the composition. Any of the N-acyl or O-acyl compounds which are conventionally used as bleach activators is suitable. The compound may be an anhydride, but is preferably an ester or, even more preferably, an amide derivative.

Amide derivatives include acyl imidazolides and N,N-di acylamides, such as TAED.

Bleaching catalysts or enzymatic activators may also be used in the compositions of the present invention. These are generally required at lower concentrations than the N-acyl or O-acyl activators, for example below 0.1%.

One or more of the optional components may be unstable under aqueous alkaline conditions or react with peroxide under aqueous alkaline conditions. This may be a particular problem for builders and/or activators and in some cases it may be advantageous to encapsulate one or more of the optional components for inclusion in the aqueous composition.

The electrolytes which may be used are any electrolytes commonly used in this type of composition either singly or mixtures of more than one electrolyte, and in amounts necessary to provide the desired degree of physical stability or viscosity to the composition. Likewise, the hydrotropes and decoupling polymers which are used are conventional and in the desired amounts for physical stability. Optionally, thickening agents may also be incorporated in the composition as an additional optional component.

Any of the above components may be in the solid form, suspended in the aqueous liquid. However, preferably all of the components are in the form of liquids, most preferably as aqueous solutions. As explained above, some components may react with peroxide or be unstable in alkaline conditions. These are preferably incorporated as encapsulated materials.

Where a combination of sequestering agents is used in the step of forming the aqueous liquid comprising sequestering agent they may be added to one another to form a pre-mix solution prior to contact with the peroxide. Preferably they are mixed with sufficient alkali to form an alkaline solution to which the peroxide is subsequently added. Alternatively, they may be added separately to aqueous alkali.

Preferably each component of the composition is contacted with at least one, preferably two sequestering agents prior to contact with the peroxide. Thus, the peroxide is only added to the other components of the composition in the presence of at least one, preferably two or more sequestering agents. Preferably, every component of the mixture potentially including transition metal ions which will contact the peroxide in the composition is pre-sequestered in a pretreatment step.

In a particularly preferred embodiment of the invention, all of the components of the oxidising concentrate composition other than the peroxide and the final presequestered further component are mixed to form a pre-mix. The respective sequestering agent or combination of sequestering agents (preferably as described in co-pending application filed today as Ser. No. 08/765,648) are then added in an amount of at least 0.01% by weight, preferably comprising at least 0.01% by weight Group A sequestering agent and at least 0.01% by weight Group B sequestering agent, the total amount of sequestering agent being no greater than 1% by weight and the pH of the composition is adjusted if necessary, preferably to a pH of from 7.5 to 11 and the peroxide is subsequently added. Final pH adjustment of the oxidising composition is required to achieve the desired pH, using pH modifier which has been pre-sequestered. Preferably the pH modifier comprises alkali.

The oxidising concentrate compositions produced in this invention may be categorised in two convenient categories.

The first category comprises liquid formulations which include a surfactant. These compositions are primarily heavy duty liquid fabric washing detergents. They are also suitable for use as hard surface cleaners and other uses where surface active disinfection and/or bleaching is required, for instance floor cleaning compositions, domestic and institutional hard surface cleaners, toilet disinfectants, general toiletries disinfectant, sanitising bottles, including glass and plastic bottles, and pipe cleaning compositions. For most of these uses it will be desirable for the composition to be relatively low foaming, although for some, for instance toilet disinfecting and general toiletries disinfectant, it may be desirable for the composition to have a relatively high foam. The use of suitable surfactants which will foam is well known in the art. For compositions which are desired to be low foam, it may desirable to incorporate anti-foaming agents, for instance soap or silicone anti-foams. Liquid formulations including surfactants may be useful in other applications such as for use to bleach fibres or fabrics, such as nappies or in fabric production, cellulose fibres, especially in paper de-inking operations, and in general environmental clean-up operations.

A second category of composition comprises liquid formulations but which contain no surfactants. These may be useful where no surface activity is necessary, for instance in effluent and water treatment, in toilet disinfectants, for use as a swimming pool treatment, for colour removal from chemicals, from pulp during paper making or recycling, in general industrial sterilisation and in some domestic sterilisation situations, for instance as a general toiletry disinfectant, in denture cleaning compositions, in sanitising glass and plastic bottles or other containers, as well as in certain environmental clean-up operations. Furthermore, where the composition is to be used as a general industrial oxidation reaction, it may be undesirable to include a surfactant.

The liquid formulations mentioned above may be pourable liquids, which are aqueous or non-aqueous, or may be in gel or paste form. Furthermore the compositions may be two-phase, for instance a cream form. Alternatively the compositions could be in the form of a mousse (where the composition contains surfactant) by the injection of a gas, especially for domestic hard surface cleaning operations. The concentrate products of the process of this invention are generally used after dilution into water, but may be used as such, especially for hard surface cleaning uses.

Examples of the invention are given below:

EXAMPLE 1

A laundry detergent liquid was prepared, the final formulation comprising the following components in the weight percentages listed:

| | |
|---|---|
| Marlon AS 3 (linear alkylbenzene sulphonate) | 7% |
| Synperonic A7 (an alcohol ethoxylated with 7 moles ethoxy groups) | 4% |
| Sodium Citrate | 5% |
| Dipyridyl amine | 0.03% |
| Dequest 2066 (DTPMP sodium salt) | 0.2% |
| Sodium hydroxide (50% w/w) | 2% |
| Hydrogen peroxide | 5% |
| Deionised water | To 100% |

In order to prepare the formulation, firstly the Marlon AS 3, Synperonic A7 and sodium citrate were mixed with deionised water at 40–50° C. to ensure rapid dissolution/dispersion to form an aqueous pre-mixed solution. The dipyridyl amine and Dequest 2066 was then added to the aqueous pre-mix, and the mixture allowed to stand for 24 hours in a pre-sequestration step.

Subsequently, hydrogen peroxide was added to the pre-sequestered pre-mix. 50% w/w pre-sequestered sodium hydroxide was then added to bring the pH of the product solution to 9.5. The pre-sequestered sodium hydroxide was prepared in advance by the addition of 0.5% D2066 to a 50% w/w solution of NaOH. This had been prepared as a stock solution and kept for several weeks. Samples were then analysed for AvOx (available oxygen) stability over a period of 26 weeks. The result are given in Table 1 which lists percentage AvOx loss (1−(measured AvOx/initial AvOx))× 100, AvOx being measured by permanganate titration. In Table 1, ambient storage refers to storage under conditions of ambient temperature, pressure and relative humidity. Accelerated storage signifies that the samples were stored at 37° C. and 80% relative humidity.

EXAMPLE 2

Example 1 was repeated with the exception that the 50% w/w sodium hydroxide which was added after the hydrogen peroxide did not undergo a pre-sequestration step. The results for Example 2 are also given in Table 1 below.

TABLE 1

| Storage Time (Weeks) | Storage Conditions | % AvOx loss Example 1 | % AvOx loss Example 2 |
|---|---|---|---|
| 6 | Accelerated | 17.6 | 28.8 |
| 12 | Accelerated | 32.9 | 61.0 |
| 12 | Ambient | 9.1 | 14.3 |
| 26 | Accelerated | 54.6 | — |

The significant improvement in stability obtained using the present invention is illustrated in Table 1. Accelerated storage conditions illustrate a particularly harsh storage environment. Even under such harsh conditions, after 26 weeks storage approximately 50% of the available oxygen remains in the composition of the present invention.

EXAMPLE 3

Example 2 shows that for the best stability the sodium hydroxide should be in contact with the sequestrant for some time before addition to peroxide. For some applications this may not be necessary as the sequestering of the sodium hydroxide or other additive may give sufficient improvement in stability on its own. To show that this is possible the inventors prepared two samples for accelerated storage testing. They were identical in all respects except that one used sequestered caustic and the other used unsequestered caustic. The sequestered caustic was added to the peroxide containing composition immediately after sequestration. The results for Example 3 are given in Table 2 below:

TABLE 2

| Sample | % AVOX lost after storage time 1 day | 1 week | 6 weeks |
|---|---|---|---|
| A (unsequestered caustic) | 95.4 | 100 | — |
| B (sequestered caustic) | 0 | 1.6 | 46 |

We claim:

1. A process for preparing an aqueous storage stable one pack alkaline composition having a pH of 7.5 to 11.5 comprising an oxidising liquid concentrate composition comprising an ingredient selected from the group consisting of hydrogen peroxide, peracid and precursors thereof and a sequestering agent, the process comprising providing a liquid comprising sequestering agent in solution; adding said ingredient to the liquid to form a solution and subsequently adding to the solution a further component selected from the group consisting of thickener, structuring agent and alkali metal hydroxide which component has been pre-sequestered.

2. A process according to claim 1 in which the said further component comprises pH-modifier.

3. A process according to claim 1 in which the said further component is a thickener or structuring agent.

4. A process according to claim 1 including, as a separate presequestration step, a step in which the said further component is contacted with an aqueous solution of a sequestrant in a presequestration mixture.

5. A process according to claim 4 in which the presequestration step is carried out for at least 45 minutes.

6. A process according to claim 4 in which the concentration of sequestrant in the presequestration mixture is in the range 0.005 to 5% by weight.

7. A process according to claim 1 in which the sequestrant used to provide the said liquid includes the same sequestrant or combination of sequestrants used for presequestration of the further component.

8. A process according to claim 1 in which the further component has been pre-sequestered by contact with a sequestering agent selected from non-cyclic aminopoly (alkylene) phosphonic acids and their salts.

9. A process according to claim 8 in which the sequestering agent is diethylenetriaminepenta(methylene phosphonic acid).

10. A process according to claim 6 in which the concentration of sequesterant in the presequestration mixture is in the range of 0.01 to 2% by weight.

11. A process according to claim 6 in which the concentration of sequesterant in the presequestration mixture is in the range of 0.01 to 1% by weight.

12. A process according to claim 6 in which the concentration of sequesterant in the presequestration mixture is in the range of 0.02 to 0.6% by weight.

13. A process according to claim 5 in which the presequestration step is carried out for at least two hours.

14. A process according to claim 1 in which the liquid to which the ingredient is added has a pH of at least 8.

15. A process according to claim 1 in which the said further component is an alkali metal hydroxide.

16. A process according to claim 15 in which the alkali metal hydroxide is sodium hydroxide.

17. A process according to claim 16 in which the sequesterant used to provide said liquid includes the same sequesterant or combination of sequestrant used for presequestration of the sodium hydroxide.

18. A process according to claim 16 in which the sodium hydroxide has been pre-sequestered by contact with a sequestering agent selected from non-cyclic aminopoly (alkaline) phosphoric acids and their salts.

19. A process according to claim 18 in which the sequestering agent is diethylenetriaminepenta(methylene phosphoric acid).

20. A process for preparing an aqueous storage stable alkaline composition having a pH of 7.5 to 11.5 comprising an oxidising liquid concentrate composition comprising an ingredient selected from the group consisting of hydrogen peroxide, peracid and precursors thereof and a sequestering agent, the process comprising providing a liquid comprising sequestering agent in solution; adding said ingredient to the liquid to form a solution and subsequently adding to the solution a further component selected from the group consisting of thickener, structuring agent and alkali metal hydroxide which component has been pre-sequestered.

21. A process according to claim 20 in which said further component is sodium hydroxide which has been pre-sequestered by contact with a non-cyclic aminopoly (alkylene) phosphoric acid or salt thereof.

* * * * *